US005611206A

United States Patent [19]

Sargent

[11] Patent Number: 5,611,206

[45] Date of Patent: Mar. 18, 1997

[54] BUTTER STORING AND CONDITIONING DEVICE

[76] Inventor: Charles L. Sargent, 3774 Cracker Way, Bonita Springs, Fla. 33923

[21] Appl. No.: 599,782

[22] Filed: Feb. 12, 1996

[51] Int. Cl.[6] ..... F25B 21/02; B65D 21/02; A47G 19/00

[52] U.S. Cl. ..... 62/3.6; 62/457.9; 220/23.4; 220/4.24; D7/502

[58] Field of Search ..... 62/3.2, 3.3, 3.6, 62/457.9, 457.6, 371; 220/574, 577, 4.24, 23.4; D7/502; D15/89

[56] References Cited

U.S. PATENT DOCUMENTS

| | | | |
|---|---|---|---|
| 1,229,282 | 6/1917 | Katzinger | 220/23.4 |
| 1,659,091 | 5/1926 | Fabbrini . | |
| 2,091,394 | 8/1937 | Park | 220/23.4 |
| 2,602,874 | 1/1950 | Briscoe . | |
| 2,948,433 | 8/1960 | Fineo | 220/23.4 |
| 3,111,166 | 11/1963 | Munz et al. | 62/3.6 |
| 3,820,251 | 6/1974 | Abernathy . | |
| 4,005,586 | 2/1977 | Lyons | 62/372 |

FOREIGN PATENT DOCUMENTS

| | | | |
|---|---|---|---|
| 2435678 | 4/1980 | France | 62/3.2 |

OTHER PUBLICATIONS

Marlow Industries, Inc. *Thermoelectric Cooling Systems Design Guide* unknown date.

*Primary Examiner*—William Doerrler
*Attorney, Agent, or Firm*—Harness Dickey & Pierce, P.L.C.

[57] ABSTRACT

A butter storing and conditioning device which maintains butter at a desired temperature to keep the butter cool enough not to melt and warm enough to easily spread. The device includes a housing which covers the butter while placed upon a butter dish resting on a counter or table top. Heating and cooling means are provided for heating or cooling the air to maintain the butter at the desired temperature. In one embodiment, an air duct is formed by the housing and a fan for circulating air through the housing and past the butter.

17 Claims, 3 Drawing Sheets

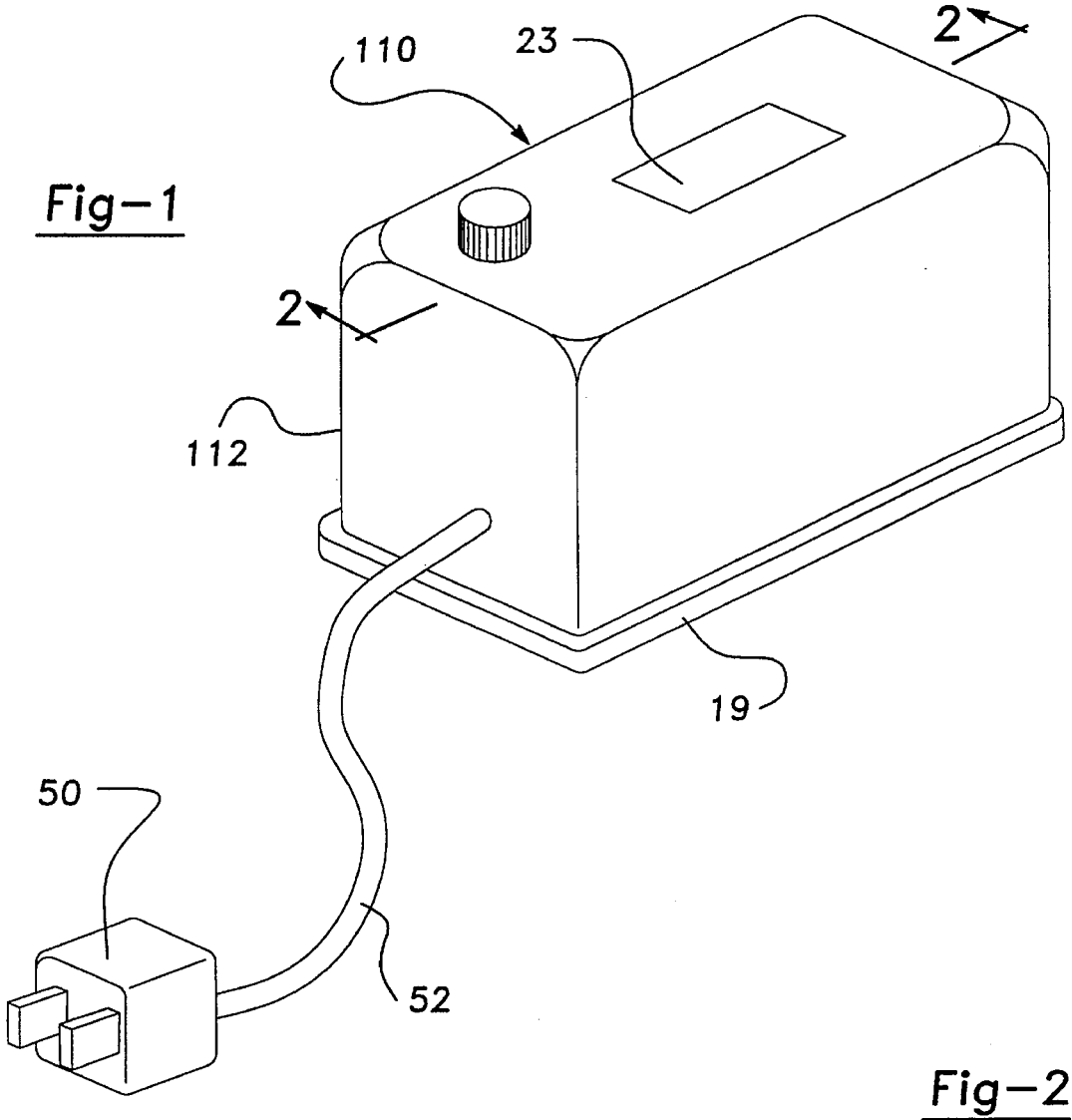
Fig-1
Fig-2
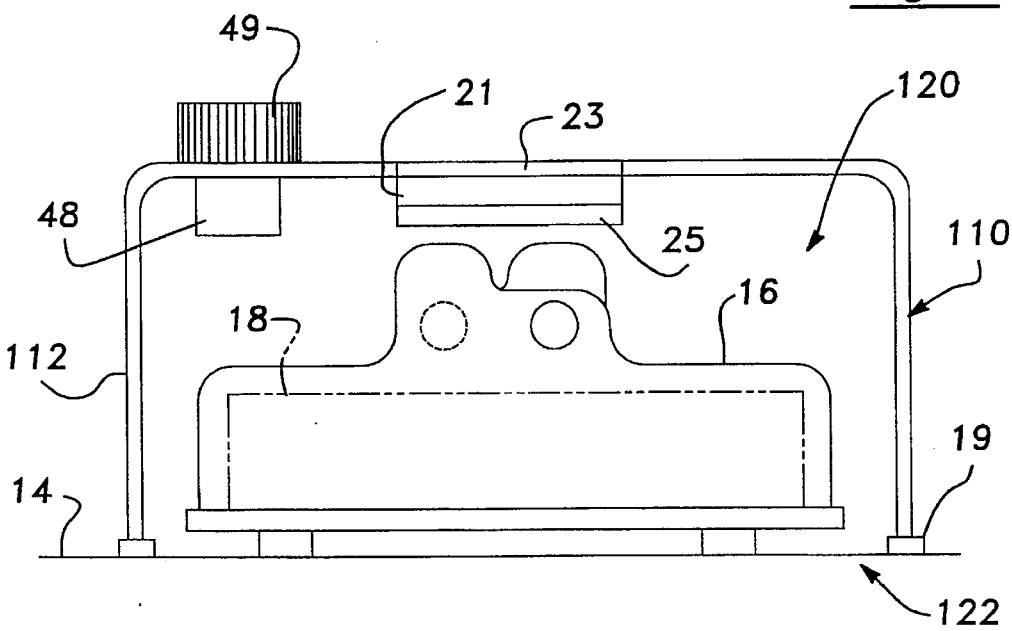

BUTTER STORING AND CONDITIONING DEVICE

BACKGROUND AND SUMMARY OF THE INVENTION

The present invention relates to a device for storing and conditioning butter and in particular to a device which maintains butter at a predetermined temperature to safely store the butter while not refrigerating the butter and making it too hard to easily use.

Butter is not able to maintain a satisfactory consistency over a very large range of temperatures. If refrigerated, it is too hard. If "left out" of the refrigerator at room temperature, it will become too soft or melt at ambient temperatures greater than approximately 80° F. Attempts have been made to introduce air into butter to make it appear softer after refrigeration. Such products, while better, do not solve the underlying problem.

Margarine and other similar spreads which remain soft and are easily spread over a large range of temperatures have been developed due to the difficulty in maintaining a satisfactory consistency of butter. Some of these products are soft enough to be spread on bread immediately after refrigeration and remain at a desirable consistency at high ambient temperatures. However, as people understand the health problems associated with margarine and other butter substitutes, they are returning to real butter.

It is an object of the present invention to provide a device for storing and conditioning butter by maintaining the butter at a desired temperature at which the butter is not too hard and is not too soft, regardless of the ambient temperature.

It is an advantage of the device of the present invention that the butter can be located where it is readily accessible for table use such as a counter top or similar location. The butter is stored at the desired temperature awaiting use. For ease of use, the device includes a housing which is simply dropped over a butter dish that is resting on a counter or table top surface.

The housing forms a butter chamber that is open from the bottom. The housing and bottom opening are preferably sized to receive two sticks of butter by placing the housing over the butter sticks. The counter or table top surface closes the open bottom of the butter chamber so that the butter is enclosed within the chamber. A heating and/or cooling device, such as a thermoelectric cooler, is provided in the housing to heat or cool the air as necessary to maintain the butter at an optimum temperature. A thermostat is provided for both determining the current temperature of the air within the butter chamber and for activating the heating and cooling device to either heat or cool, as needed, to produce the desired temperature in the butter chamber.

In an alternative embodiment of the device, the housing also includes an air duct which forms a circulation passage for circulating air through the butter chamber and over the butter. A fan is provided to move air through the air duct and the butter chamber.

The device also includes a butter dish which is designed for use with the housing and can hold two quarter-pound sticks of butter. The dish is preferably constructed of two identical halves that can be separated from one another so that one half of the dish can be used on the table while the other half is being cleaned.

Further objects, features and advantages of the invention will become apparent from a consideration of the following description and the appended claims when taken in connection with the accompanying drawings.

BRIEF DESCRIPTION OF THE DRAWINGS

FIG. 1 is a perspective view of the butter storing and conditioning device of the present invention;

FIG. 2 is a sectional view of the butter storing and conditioning device of the present invention as seen from substantially the line 2—2 of FIG. 1;

DETAILED DESCRIPTION OF THE PREFERRED EMBODIMENT

Figure 3:
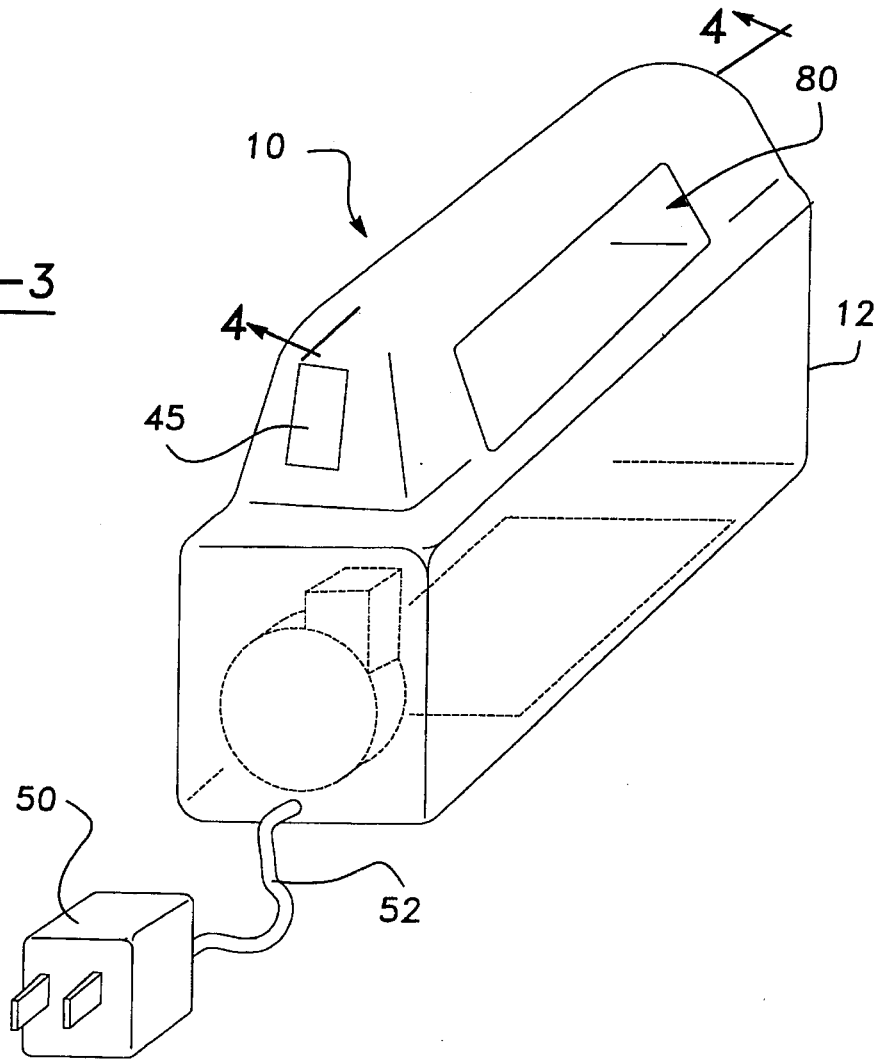
FIG. 3 is a perspective view of the housing portion of the butter storing and conditioning device of the present invention.

The butter storing and conditioning device of the present invention is shown in FIGS. 1 and 2. The device includes a housing designated generally as 110 and a butter dish designated as 16. The housing 110 is in the form of a cover 112 and is shown in FIG. 2 resting upon a counter or table top surface 14. The butter dish 16 is also resting on the counter top surface and supports a stick of butter 18. The housing 110 has a butter chamber 120 which has an open bottom 122. The open bottom 122 allows the housing 110 to be dropped over the butter dish whereby the butter dish is enclosed within the chamber 120. An elastomeric seal 19 is provided about the periphery of the open bottom 122 so that when the housing 110 is placed over the butter dish, a seal is formed between the top surface 14 and the housing 110 so that air does not flow in and out of the butter chamber 120.

The air within the butter chamber 120 is heated or cooled by a heating and cooling device 21 placed within the butter chamber. In a preferred embodiment, the heating and cooling device is a thermoelectric cooler which can heat or cool. The thermoelectric cooler has a unique characteristic of being able to heat or cool with a simple polarity change. Thermoelectric coolers are available from Marlow Industries, Inc. in Dallas, Tex. A typical single stage thermoelectric cooler consists of two ceramic plates with p- and n-type semiconductor material (bismuth telluride) between the plates. The elements of semiconductor material are connected electrically in series and thermally in parallel. When a positive DC voltage is applied to the n-type thermoelement, electrons pass from the p- to the n-type thermoelement and the cold side temperature will decrease as heat is absorbed. The heat absorption (cooling)is proportional to the current and the number of thermoelectric couples. The heat is transferred to the hot side of the cooler, where it is dissipated into the heat sink and surrounding environment. The range of heat pumping rates for thermoelectric coolers is in milliwatts to hundreds of watts. As a result, they are well suited for use in a butter conditioner where the heating and cooling requirements are small.

The thermoelectric cooler is sandwiched between a pair of heat sinks or exchangers, 23, 25. The heat sink 23 extends through the housing 110 so as to be in contact with the surrounding environment. The heat sink 25 is within the housing 110. The thermoelectric cooler moves heat between the two heat sinks. A thermostat 48 is located in the butter chamber to measure the air temperature within the chamber and to control the heating or cooling of the device 21. The thermostat 48 can be preset to a fixed temperature, or the thermostat can be provided with a knob 49 for use in adjusting the desired temperature within the butter chamber based on the user's preference. While the thermoelectric cooler provides the easiest way to both heat and cool and requires a minimal amount of space, other heating or cooling devices can be used. For example, a small resistance heater can be used to heat the air. A small absorber can be used to cool the air, and depending on how it is figured, an absorber could also be used to heat, as well. The thermoelectric cooler provides the most economical way to both heat and cool, requiring a minimum amount of space within the butter chamber.

Through an electric circuit (not shown), feedback is provided from the thermostat 48 that is used to select the polarity of the current provided to the thermoelectric cooler, thus controlling the heating and cooling functions. The thermostat and thermoelectric cooler are powered by a 12 V transformer 50 which plugs into a standard 110 V wall outlet. The transformer is coupled to the housing by wire 52.

The desired temperature for maintaining the butter is higher than a refrigerator temperature. It will likely not be higher than 75° F. As a result, it is possible to rely on room temperature air to provide the necessary heat to warm the butter. The thermoelectric cooler may only be used to cool the butter when the room temperature exceeds a given temperature, for example, 75° F. Using the thermoelectric cooler only for cooling purposes can simplify the electronics since there is no longer a need to change the polarity of the current supplied to the cooler. A simple circuit can be used with the thermostat functioning solely as an on-off switch for cooling.

Figure 4:
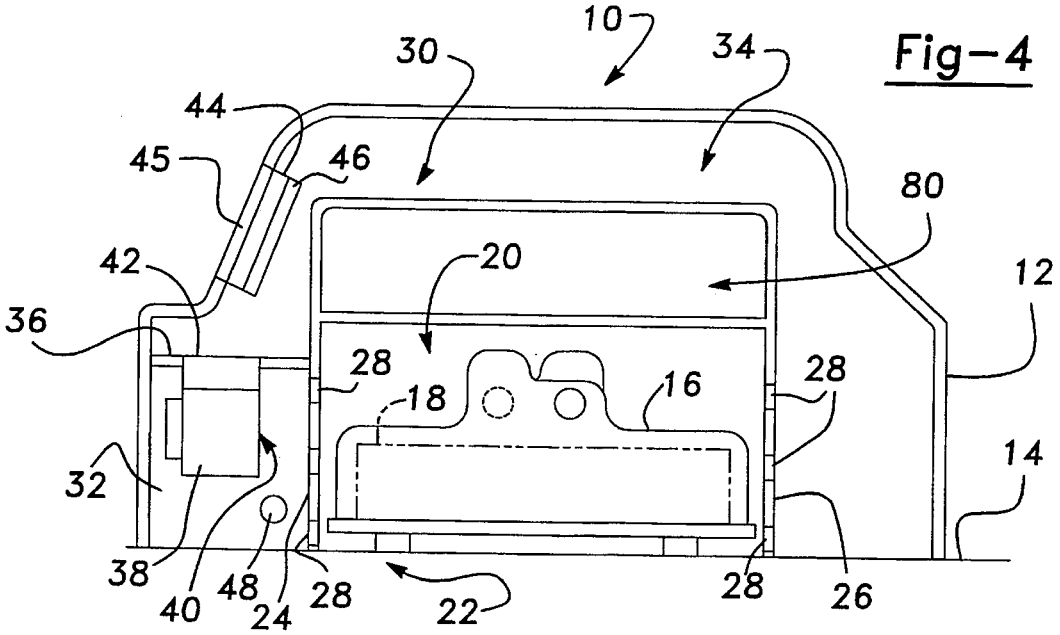
FIG. 4 is a side sectional view of the housing as seen from substantially the line 4—4 of FIG. 3.

An alternative embodiment of the butter storing and conditioning device of the present invention is shown in FIGS. 3 and 4. The device includes a housing designated generally as 10 and the butter dish 16. The housing 10 is in the form of a cover 12 and is shown in FIG. 4 resting upon the counter or table table top surface 14. The butter dish 16, is also resting on the counter top surface supporting the stick of butter 18. The housing 10 has a butter chamber 20 which has an open bottom 22. The open bottom 22 allows the housing 10 to be dropped over the butter dish 16, whereby the butter dish is enclosed within the chamber 20.

Two walls 24, 26 which form the butter chamber 20 are formed with circulation holes 28 to allow air to pass through these walls. Preferably, the walls 24, 26 are on opposite ends of the butter chamber to allow air flow throughout the butter chamber as described below.

The housing 10 also forms an air duct 30 which allows the air to circulate from one end of the butter chamber, through the air duct 30 and then back into the butter chamber at the opposite end, forming an endless air circulation path. To facilitate air circulation, the air duct 30 is divided into two separate chambers, a fan chamber 32 and an upper plenum 34. A plenum wall 36 separates the fan chamber from the upper plenum. A circulation fan 38 is located within the fan chamber and has an air inlet 40 for receiving air from within the fan chamber. The fan air outlet 42 is located in the plenum wall 36 such that the air from the fan is blown into the upper plenum 34. This creates a higher air pressure within the upper plenum 34, relative to the fan chamber 32 and the butter chamber 20, and a lower air pressure in the fan chamber than in the butter chamber. As a result, air flows from the butter chamber into the fan chamber and from the upper plenum into the butter chamber. This completes the air circulation through the housing 10. The upper plenum 34 is spaced above the butter chamber 20 to form an opening 80 therebetween. The upper plenum is shaped to form a handle for easily grasping the housing.

The air within the housing is heated or cooled by heating and cooling devices contained within the air duct 30. As described above, the heating and cooling is preferably accomplished with a thermoelectric cooler 44. The cooler 44 either heats or cools a finned heat sink 46 through which the air from the fan outlet 42 passes. A second heat sink 45 is on the other side of the cooler 44 and extends through the housing 10A thermostat 48, preferably located in the fan chamber 32, is used to regulate the temperature of the air being drawn into the fan chamber from the butter chamber 20. The thermostat 48 can be preset to a fixed temperature or the temperature can be varied by the user as described above. The fan, thermostat and thermoelectric cooler are all powered by the 12V transformer 50.

The thermostat 48 is preferably located in the fan chamber where it can measure the temperature of the air as it flows into the fan chamber from the butter chamber. The thermostat can be positioned in other locations within the air duct 30 if desired. The thermoelectric cooler 44 and heat sink 46 are preferably located in the upper plenum 34 near the fan outlet 42 so air from the fan can be directed toward and through the heat sink 46. The thermoelectric cooler and heat exchanger could be located elsewhere in the air duct if desired.

Figure 5:
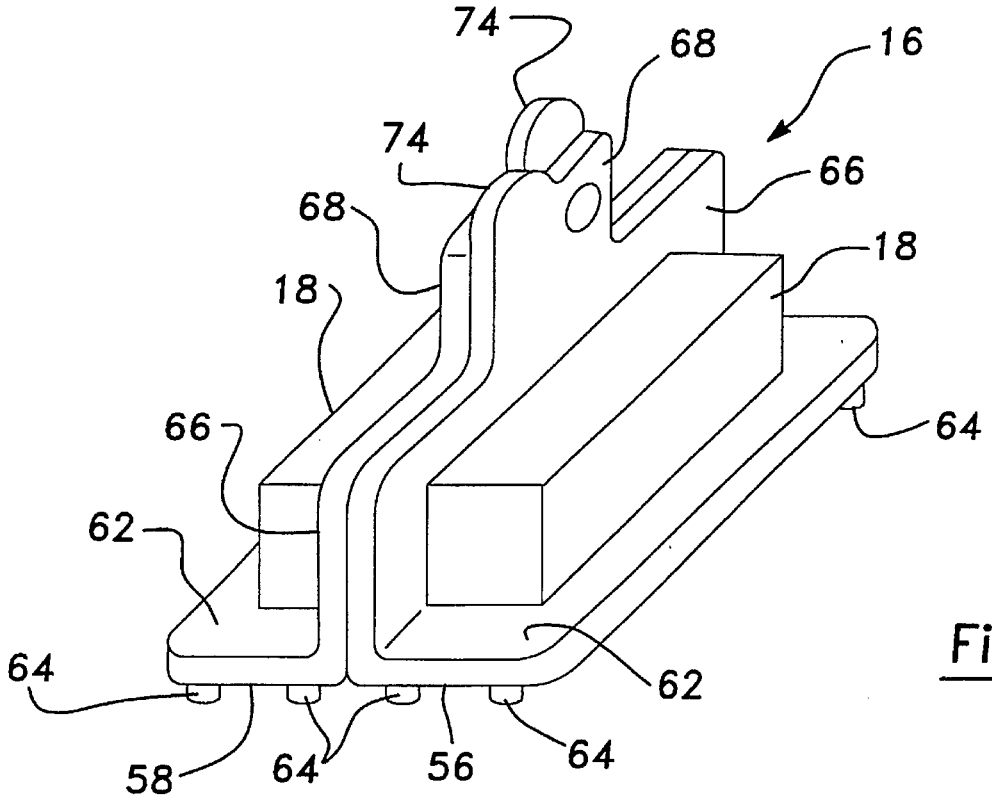
FIG. 5 is a perspective view of the butter dish portion of the storing and conditioning device.
Figure 6:
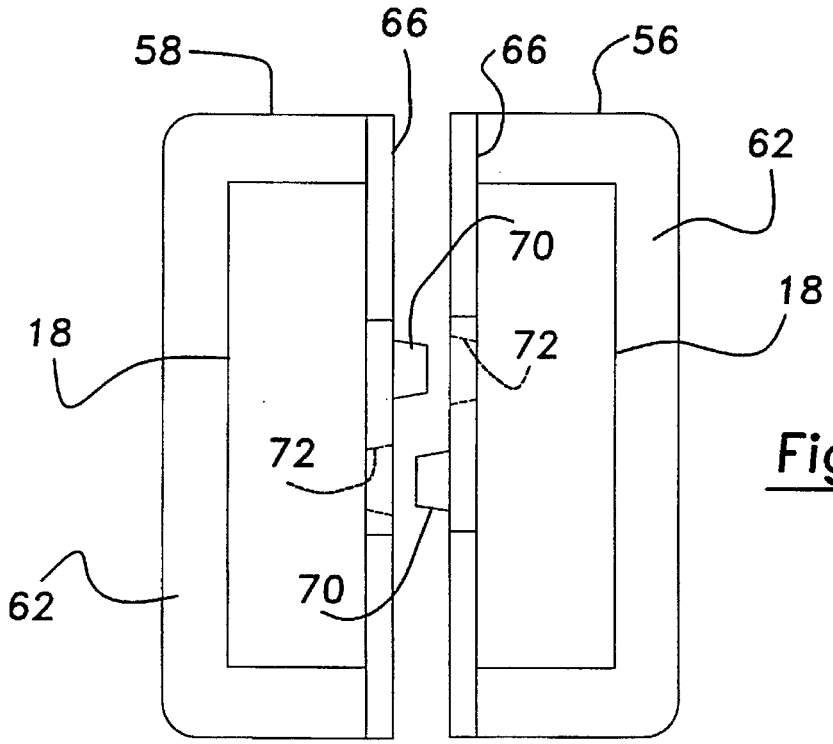
FIG. 6 is a top plan view of the butter dish shown in FIG. 5.

With reference to FIGS. 5 and 6, the butter dish 16 is shown which is specifically designed for use with the housings 10, 110 to store and condition butter. The butter dish 16 is constructed of identical halves 56, 58. Each dish half is designed to carry a quarter-pound stick of butter 18. Each dish half includes a lower horizontal support wall 62 having downwardly extending legs 64. The legs 64 raise the horizontal support wall 62 above the counter top surface, allowing air to circulate beneath the horizontal support wall 62. Along one longitudinal edge of the horizontal wall 62, a vertical wall 66 extends upwardly above the height of the butter stick.

Each vertical wall 66 includes an upwardly extending tab 68. The tabs 68 provide a grip for grasping the butter dish to carry it from one location to another. Each tab 68 includes a laterally extending boss 70 and a complementary aperture 72. By making the dish halves identical to one another, two dish halves can be positioned side-by-side with the boss 70 of one dish half inserted into the aperture 72 of the other dish half, thereby interlocking the two dish halves together.

Each of the tabs 68 has an upwardly extending tab protrusion 74. The protrusion 74 is located off center so that the protrusions of the two halves do not align with one another when the two identical dish halves are placed together. The protrusions are provided to facilitate separation of the two dish halves as they sit on the counter top. By having two separable dish halves, one half can be washed and reloaded with a fresh stick of butter while the other dish half is employed for table use. This would generally make conditioned butter available at all times. Additionally, two sticks of conditioned butter can be available, if needed, for serving a large number of people.

The butter storing and conditioning device of the present invention provides a means for regulating the temperature of butter at a desired temperature at which the butter is neither too hard nor too soft and is readily available and easily accessible for use. The device includes a housing which can be placed over the butter while placed on a counter top or table surface. The butter is available for use by simply removing the housing.

It is to be understood that the invention is not limited to the exact construction illustrated and described above, but that various changes and modifications may be made without departing from the spirit and scope of the invention as defined in the following claims.

I claim:

1. A device for maintaining a stick of butter set upon a counter or table top surface at a desired temperature comprising:

a housing forming a butter chamber having an open bottom of a size sufficiently large for the stick of butter to be received into said butter chamber by placement of said housing over the stick of butter with the top surface closing the open bottom of said butter chamber whereby the stick of butter is enclosed within said butter chamber;

temperature means for cooling the air within said butter chamber to cool the stick of butter; and thermostat means coupled to said temperature means for controlling the operation of said temperature means to cool the air within said butter chamber depending upon the air temperature within said housing in order to maintain a predetermined air temperature within said butter chamber.

2. The device of claim 1 wherein said temperature means includes a thermoelectric cooler.

3. The device of claim 2 wherein said thermoelectric cooler is capable of both heating and cooling depending upon the polarity of electric current supplied to said cooler.

4. The device of claim 1 further comprising adjustment means for adjusting the predetermined air temperature within said butter chamber.

5. The device of claim 1 further comprising a seal disposed about said open bottom of said housing to prevent air flow between said housing and the top surface.

6. The device of claim 1 wherein said butter chamber has first and second spaced walls and said housing further forms an air duct having a first end in communication with said butter chamber through at least one aperture in said first wall and said air duct having a second end in communication with said butter chamber through at least one aperture in said second wall whereby said air duct and said butter chamber form an endless air circulation path; and further comprising blower means within said housing for circulating air through said air circulation path.

7. The device of claim 6 wherein said temperature means includes a thermoelectric cooler capable of either heating or cooling depending upon the polarity of electric current supplied to said cooler.

8. The device of claim 6 wherein:

said air duct includes a fan chamber formed in part by said first wall of said butter chamber and an upper plenum separated from said fan chamber by a plenum wall and formed in part by said second wall of said butter chamber; and said blower means includes a fan disposed in said fan chamber, said fan having an inlet in said fan chamber for receiving air from within said fan chamber and an outlet in said upper plenum for delivering air from said fan to said upper plenum.

9. The device of claim 6 wherein said air duct is sized and shaped to form a handle for lifting said housing.

10. A device for maintaining butter at a desired temperature comprising:

a dish for supporting a stick of butter upon a counter or table top surface;

a housing forming a butter chamber having an open bottom of a size sufficiently large for said dish to be received into said butter chamber by placement of said housing over said dish and the stick of butter with the top surface closing the open bottom of said butter chamber whereby the stick of butter is enclosed within said butter chamber;

temperature means for cooling the air within said butter chamber to cool the stick of butter; and thermostat means coupled to said temperature means for controlling the operation of said temperature means to cool the air within said butter chamber depending upon the air temperature within said housing.

11. The device of claim 10 wherein said dish is assembled of two identical dish halves each of which can carry a quarter pound stick of butter.

12. The device of claim 11 wherein said dish halves each include a horizontal support wall upon which the butter is placed, legs raising said horizontal support wall above the horizontal surface and a vertical wall extending upward from said horizontal support wall above the stick of butter placed upon said horizontal support wall.

13. The device of claim 12 wherein said dish halves each have a boss extending laterally from said vertical wall and away from the stick of butter and a complementary aperture extending into said vertical wall to receive said extending boss of the other dish half whereby a pair of said identical dish halves can be arranged side by side with said vertical walls engaging one another with the extending boss of one dish half extending into the aperture of the other dish half.

14. The device of claim 13 further comprising a protrusion extending upward from said vertical wall of each of said dish halves, said protrusion being spaced from the longitudinal center of said dish half whereby said protrusions of said pair of dish halves can be used to separate said dish halves from one another.

15. A dish for supporting two quarter pound sticks of butter comprising:

two identical dish halves each of which can carry a single quarter pound stick of butter, said dish halves each including a horizontal support wall upon which the butter is placed and a vertical wall extending upward from said horizontal support wall along one edge of said horizontal support wall and parallel to the length of the stick of butter, said vertical wall extending above the stick of butter placed upon said horizontal support wall; and said dish halves having means for joining said dish halves to one another with said vertical walls of said dish halves engaging one another.

16. The dish of claim 15 wherein said means for joining said dish halves to one another includes a boss extending laterally from said vertical wall and away from the stick of butter and a complementary aperture extending into said vertical wall to receive said extending boss of the other dish half whereby a pair of said identical dish halves can be arranged side by side with said vertical walls engaging one another with the extending boss of one dish half extending into the aperture of the other dish half.

17. The device of claim 16 further comprising a protrusion extending upward from said vertical wall of each of said dish halves, said protrusion being spaced from the longitudinal center of each dish half whereby said protrusions of said pair of dish halves can be used to separate said dish halves from one another.

* * * * *